United States Patent [19]

Ruttenberg

[11] 4,253,281

[45] Mar. 3, 1981

[54] ANTI-GUTTER CLOGGING AND DEBRIS REMOVAL DEVICE

[76] Inventor: Michael Ruttenberg, 2428 S. Conway, Apt. 282, Orlando, Fla. 32806

[21] Appl. No.: 91,834

[22] Filed: Nov. 6, 1979

[51] Int. Cl.[3] ..... E04D 13/00

[52] U.S. Cl. ..... 52/12; 210/400

[58] Field of Search ..... 52/11, 12; 210/400, 210/160

[56] References Cited

U.S. PATENT DOCUMENTS

| | | | |
|---|---|---|---|
| 2,885,080 | 5/1959 | Goldman | 210/160 |
| 3,740,787 | 6/1973 | Bowermaster | 52/12 X |
| 3,976,573 | 8/1976 | Miller | 210/160 X |
| 4,032,456 | 6/1977 | Berce | 52/12 X |
| 4,036,761 | 7/1977 | Rankin | 52/12 X |
| 4,116,008 | 9/1978 | Ward | 52/12 X |

*Primary Examiner*—Carl D. Friedman

*Attorney, Agent, or Firm*—Marvin S. Siskind

[57] ABSTRACT

An anti-clogging and debris removal device is positionable to cover the opening in an open-topped, elongated gutter member so as to maintain the gutter member free from the flow-obstructing effects of leaves, twigs or other debris. The anti-clogging and debris-removal device includes rollers securely positioned adjacent each of the distal longitudinal ends of the gutter member, a continuous, endless, mesh-like conveyor belt trained for rotation about the rollers, and a selectively actuatable drive assembly for selectively rotating the rollers to longitudinally move the endless conveyor belt so as to transport leaves, twigs and other debris which collect on the conveyor belt to one of the distal ends of the gutter. The conveyor belt is of a width substantially equal to the width of the gutter member to prevent debris from entering the gutter between the gutter member and the edge of the belt. The drive assembly is preferably a DC motor, but other mechanical alternatives, such as a crank and pulley or a wind-activated propeller can also be employed.

6 Claims, 3 Drawing Figures

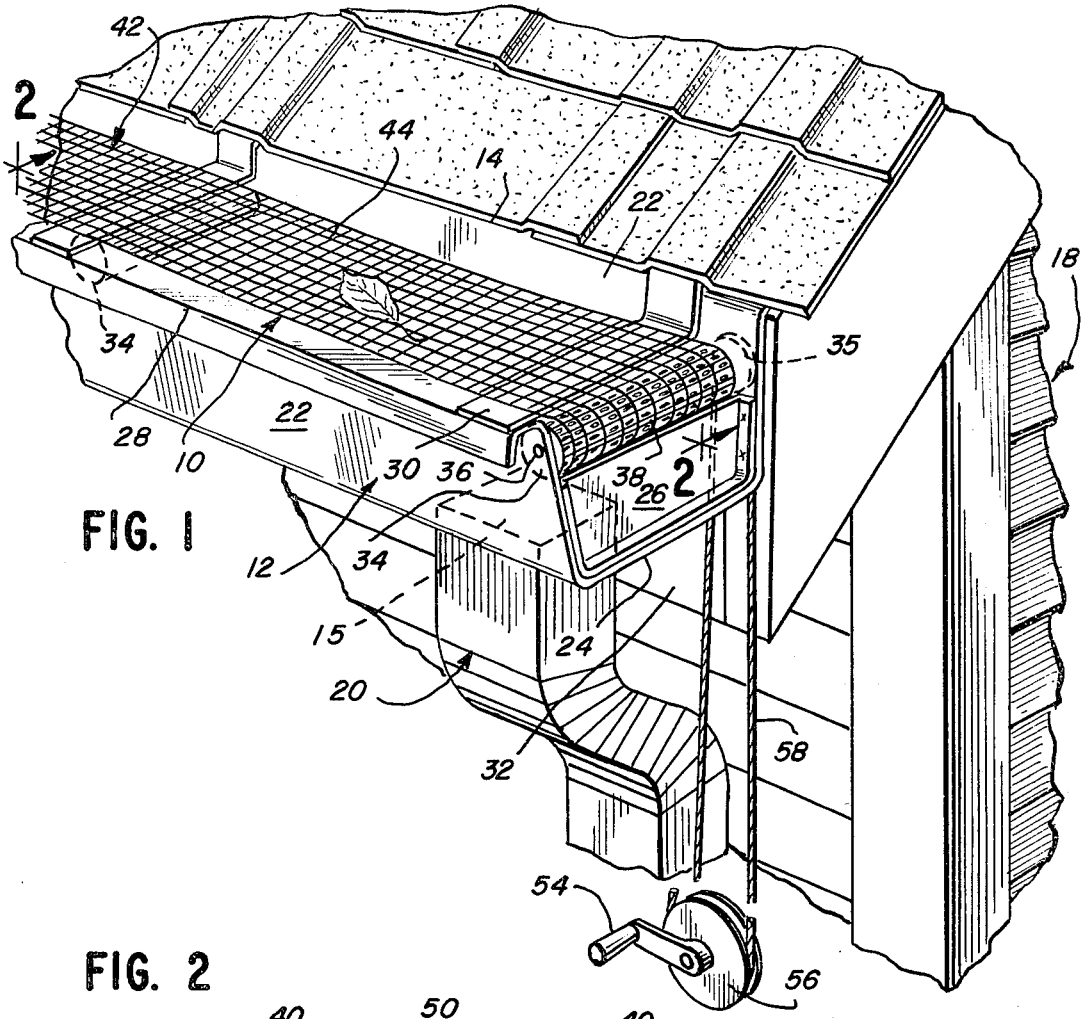
FIG. 1
FIG. 2
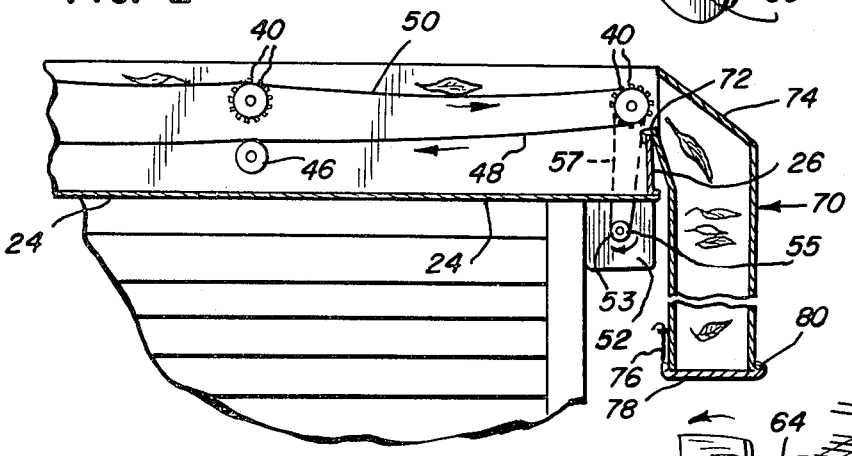
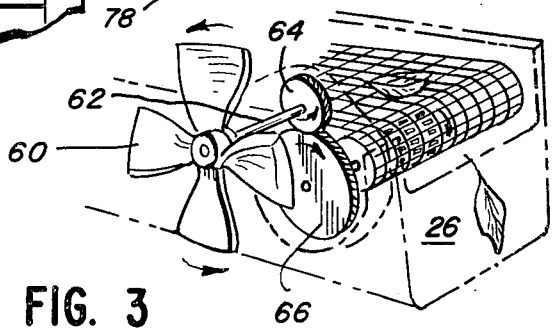
FIG. 3

ANTI-GUTTER CLOGGING AND DEBRIS REMOVAL DEVICE

FIELD OF THE INVENTION

This invention relates generally to gutter cleaning devices and more particularly to an anti-clogging and debris removal device which prevents twigs, leaves and other debris from obstructing the flow of moisture within and from the gutter.

BACKGROUND OF THE INVENTION

Gutters are commonly employed to receive rain water and other moisture from the roof tops of commercial or residential buildings and direct said moisture to a downspout which is adapted to lead the moisture from the gutter to a sewer system or other type of moisture disposed network.

Gutters, being generally U-shaped, open-topped members, accumulate leaves, twigs and other wind-blown debris therein. The accumulation of debris in the flow channel formed by the walls of the U-shaped gutter members can interfere with or altogether block the flow of moisture to the downspout, which results in water spilling over the sides of the gutters. The owner of the building therefore confronts a periodic maintenance chore in which he climbs atop the roof of the building to remove the obstructing debris from the channel in order to restore water flow therein and prevent water from overflowing the sides of the gutters.

In an attempt to provide a solution to the problem of removing debris which has accumulated in gutter systems, it is known, as shown in U.S. Pat. Nos. 2,841,100 and 3,977,135, to place screen-type members over the open-topped gutters. However, such prior screen-type systems dispose of the accumulated debris by tilting or pivoting the screen-type members along the entire longitudinal length of the gutters. Although this does accomplish the removal of debris, it is an awkward procedure which dumps debris from the entire longitudinal length of the roof line, on the ground, thereby still leaving the homeowner or custodian with a time-consuming and effort-exerting clean-up operation.

It is therefore one object of the present invention to provide an anti-clogging and debris removal device which maintains gutters free from the flow obstructing effects of leaves, twigs and other debris without otherwise burdening the homeowner or custodian.

It is yet another object of the present invention to provide an anti-clogging and debris removal device which includes a movable, mesh-like conveyor belt covering the open, top end of the gutter and which is adapted to transport debris longitudinally toward one end of the gutter for collection and removal.

These and other objects and advantages of the invention will become apparent from the following description of the preferred embodiments of the invention.

BRIEF SUMMARY OF THE INVENTION

The anti-clogging and debris removal device of the present invention is adapted to maintain gutters free from the flow-obstructing effects of leaves, twigs and other debris which can prevent the free flow of water within and from a gutter. Gutters are longitudinally elongated, horizontally disposed, generally channel-shaped members defined by opposed, generally upright side walls, a bottom wall spacing said side walls and opposite distal end walls. Gutters are adapted to collect precipitation and other moisture from the roofs of buildings and direct the moisture away from the foundations of the buildings.

The anti-clogging and debris removal device includes rotatable rollers securely positioned adjacent the distal end walls of the elongated, channel-shaped gutters, a continuous, endless conveyor belt trained for rotation about the rollers, and a selectively actuatable drive means for selectively rotating the rollers to longitudinally move the endless conveyor belt so as to transport leaves, twigs and other debris which collect on the conveyor belt to a distal end wall of the gutter for removal.

The conveyor belt is preferably formed from galvanized steel but other rust-resistant materials may be used. Regardless of the material used, the width of the conveyor belt must be only slightly less than the width of the space between the side walls of the gutter to prevent debris from entering the gutter between the side wall and the edge of the conveyor belt.

The selectively actuatable drive means can be a DC motor, a manually operated crank, or a wind-activated propeller. It is only necessary that: (1) sufficient power be generated to move the conveyor belt along the longitudinal extent of the gutter; and (2) the drive means be activatable from a readily accessible location.

A debris collecting receptacle may be positioned adjacent one of the distal end walls of the gutter for receiving the twigs, leaves and other debris from the conveyor belt as the conveyor belt approaches the distal end of the gutter. The receptacle is preferably a longitudinally elongated member extending from the gutter to a point adjacent the ground from which it can easily be emptied of debris.

BRIEF DESCRIPTION OF THE DRAWINGS

FIG. 1 is a partial perspective view of the anti-clogging and debris removal device of the present invention shown operably attached to the gutter and downspout and adapted for longitudinal movement when a manually operated crank is rotated.

FIG. 2 is a cross-sectional view of the gutter and conveyor belt of the present invention taken along line 2—2 of FIG. 1, illustrating a debris collecting receptacle and shown powered by a DC motor; and further FIG. 3 is a partial perspective view of the conveyor belt of the present invention shown powered by a wind-blown propeller.

DETAILED DESCRIPTION OF THE INVENTION

Referring now to the drawings and particularly to FIG. 1, the anti-clogging and debris removal device (hereinafter referred to as "debris removal device") of the present invention is illustrated generally by the reference numeral 10. The debris removal device 10 is adapted to be secured to an eave trough or gutter 12. Gutters such as 12 are normally positioned adjacent to, but just below, the edge 14 of the sloping roof 16 of most residential and commercial buildings 18. Although FIG. 1 depicts a shingle-type roof 16 and therefore the roof is shown as being steeply angled relative to the horizontal, all roofs are angled to some degree relative to the horizontal so as to provide drainage therefrom into the gutters 12. The water or other moisture thereby is adapted to flow off the roof 16, collect in the gutters 12, pass through an opening 15 adjacent one end of the gutter 12 and be carried by downspout 20 away from the foundation of the building 18.

The gutters 12 illustrated in FIGS. 1–3, are longitudinally elongated, generally horizontally disposed, generally channel-shaped members normally formed of thin aluminum or other inexpensive and rust-resistant material. The channel shape of said gutter members is defined by opposed, generally upright side walls 22, a bottom wall 24 which serves to space apart the side walls 22, and oppositely disposed end walls 26 (only one end wall being shown in the Figures). The upper edge of the side walls 22 of the gutters 12 may be flanged as at 28 for rigidification. Aluminum strips 30 extend between the side walls 22 at regular intervals along the longitudinal extent of the gutters 12 to maintain said space between said side walls 22. Although gutters 12 are depicted as being upwardly flaring in cross-sectional shape, they may assume other conventional cross-sectional shapes, such as circular or rectangular, without departing from the spirit and scope of the present invention. Regardless of the shape of the gutters 12, they are open-topped members secured by any conventional means to the facia 32 of the roof so as to slightly cant to the horizontal in the direction of the downspout 20. This permits moisture that has collected in gutters 12 to be acted upon by the force of gravity so as to flow through the opening 15 in the gutter 20 and drain via the downspout 20.

The downspout 20 is a longitudinally elongated, continuous, tubular element extending from the opening 15 in the bottom wall 24 of the gutter 12. It is usually connected to a sewer system or other conduit for guiding moisture away from the foundation of the building 18. The shape of the downspout 12 or the manner in which moisture exits therefrom can vary without affecting the operation of the debris removal device 10 of this invention.

The debris removal device 10 includes a plurality of elongated drive rollers 34, each having an axle 36 spacedly and rotatably secured to the upper edge of the side walls 22 along the length of the gutters 12. A plurality of gears, such as 38, having a plurality of radially extending gear teeth 40 are spaced along the length of each of the rollers 34. The spacing of the rollers 38 along the longitudinal extent of the gutters 12 is not critical as long as one of the rollers 34 is rotatably positioned adjacent each distal end wall 26 of the said gutters 12. One of the rollers 34 is a drive roller and is further provided with a driven pulley element 35 which is driven as explained hereinafter.

A continuous, endless, mesh-like conveyor belt, such as a galvanized steel screen, is trained for rotation about the rollers 34 such that the interstices 44 of mesh-like conveyor belt 38 are drivingly engaged by the gear teeth 40 of at least said roller 34 having the driven pulley element 35. The conveyor belt 38 has a width only slightly less than the space between the side walls 22 adjacent the open-topped end of the gutters 12 so that small twigs, leaves or other debris are unable to slide into the gutters 12 between the edge of the conveyor belt 42 and the side walls 22 of the gutters.

For purposes of rotating the conveyor belt 42, it is only necessary that one of the rollers 34 include gears 38, although all of the rollers 34 may be so equipped. It should also be apparent that, although a gear-type drive is preferred and achieves the best results, other types of drive-means, such as a roller fabricated of a material having a high coefficient of friction for frictionally moving the conveyor belt 42 could be used without departing from the scope of Applicant's invention. Further, idler rollers such as 46 may be positioned below rollers 38 for supporting the weight of the lower run 48 of the conveyor belt 42. The upper run 50 of the conveyor belt 42 is additionally supported by the regularly intervalled spacing strips 30.

A selectively actuatable motor 52 is employed, in the preferred embodiment of FIG. 2, to rotate the drive rollers 34. The motor 52 operates on direct current and could draw power from a battery bank or other commonly used source. The motor 52 is positioned beneath the bottom wall 24 of the gutter to shelter it from moisture. In severe climates, aluminum enclosures (not shown) could further envelop the motor. Regardless of its source of power and the type of enclosure, the motor 52 is selectively operable to rotate a drive axle 53 and a drive pulley 55. The drive pulley 55 transmits its rotary motion via a cable or wire 57 to the driven pulley 35, which then operates to rotate roller 34 and drive the conveyor belt 42. In order to activate the motor 52, a switch may be provided at a readily accessible location, interiorally or exteriorally of the building. Alternatively, remotely controlled, high frequency sound waves could be used to actuate the motor, i.e., such as are commonly used with garage door openers.

In a second preferred embodiment of the conveyor belt drive means, a manually operable, rotatable crank 54 drives the conveyor belt 42 by transmitting its rotary motion via an endless cable-type belt 58 which is secured between the drive pulley 56 and the driven pulley 35. The driven pulley 56 and crank 54 are secured to the side of building 18 at a level easily reachable by a person desirous of rotating the crank 54 to move the conveyor belt 42.

In both the motor-powered embodiment 52 and the crank driven embodiment 54, pulleys and endless drive cables have been described. However, gears and chain-link belts would provide equally acceptable, albeit more expensive substitutes.

A third preferred embodiment of the conveyor belt drive means includes a propeller 60 secured for rotation on an axle 62 which is mounted to the side walls 22 of the gutter 12. Secured to the axle 62 is a drive gear 64 adapted to mesh with a driven gear 66 affixed to the axle 36 of one of the rollers 34. In this embodiment, the wind is harnassed to provide the energy to rotate the driven rollers 34 which rotate the endless conveyor belt 42.

In all of the embodiments described above, rotation of the driven rollers 34 operates to longitudinally move the endless conveyor belt 42 from one distal end of the gutter 12 to the other distal end 26. As the conveyor belt 42 traverses the longitudinal upper run 50 between the distal ends of the gutter 12, twigs, leaves and other debris collected on the conveyor belt 42 are carried by said belt 50 to one of said distal ends 26. As the debris reaches the distal end 26, it will fall under the influence of gravity to the ground where the user of the device may sweep, rake or otherwise collect the debris for removal.

Alternatively, an elongated debris-collecting receptacle 70 may be positioned adjacent said distal end 26 to receive the falling debris. The receptacle 70 may be of any size and shape, but it is desirable that it include a lip 72 to hook over the distal end wall 26 of the gutter 12 and a hood 74 to prevent the ingress of moisture. Although the receptacle 70 is depicted in FIG. 2 as extending only a small distance below the gutter 12, it could be longitudinally elongated to extend to within a few feet of the ground. By longitudinally extending the receptacle 70, the user, without using a ladder, is able to open a latch 76 at the underside of the receptacle 70 and pivot the bottom wall 78 about pivot pin 80 to remove debris collected therein.

While several forms of the invention have been described, it will be understood that the invention may be utilized in yet other forms and environments, so that the purpose of the appended claims is to cover all such forms of devices not disclosed but which embody the invention disclosed herein.

I claim:

1. An anti-clogging and debris removal device for maintaining gutters free from the flow obstructing effects of leaves, twigs and other debris which prevent the free flow of water within and from said gutters; the gutters being longitudinally elongated, horizontally disposed, generally channel-shaped members, said channel-shaped members defined by opposed, generally upright side walls, a bottom wall spacing said side walls and opposite, distal end walls, said channel-shaped gutter members adapted to collect and remove precipitation and other moisture from the roofs of buildings; the anti-clogging and debris removal device comprising, in combination:

rotatable roller means securely positioned adjacent the opposite distal end walls of an elongated, channel-shaped gutter member;

a continuous, endless, mesh-like conveyor belt trained for rotation about said roller means, said conveyor belt having a width only slightly less than the space between the side walls of said channel-shaped gutter member; and selectively actuatable drive means for selectively rotating said roller means whereby activation of said drive means operates to rotate said roller means and longitudinally move the endless conveyor belt to transport leaves, twigs and other debris which have collected on the conveyor belt to a distal end wall of the elongated, channel-shaped gutter member for removal.

2. An anti-clogging and debris removal device as in claim 1, wherein said drive means is a DC motor operatively connected to said roller means for rotation thereof.

3. An anti-clogging and debris removal device as in claim 1, wherein said drive means is a crank operatively connected to said roller means for rotation thereof.

4. An anti-clogging and debris removal device as in claims 2 or 3, including remote control means for remote activation of said drive means.

5. An anti-clogging and debris removal device as in claim 1, wherein said drive means is a wind-activated propeller operatively connected to said roller means for rotation thereof.

6. An anti-clogging and debris removal device as in claim 1, including means, positioned adjacent one of the distal end walls of a channel-shaped gutter member, for receiving the leaves, twigs and other debris from the mesh-like conveyor belt as the conveyor belt approaches said distal end of the channel-shaped gutter.

* * * * *